US007485791B2

(12) United States Patent
Takegawa

(10) Patent No.: US 7,485,791 B2
(45) Date of Patent: Feb. 3, 2009

(54) GOLDEN RATIO AIR VENT HOLES

(75) Inventor: Akito Takegawa, Chiba (JP)

(73) Assignee: Pearl Musical Instrument Co., Chiba (JP)

( * ) Notice: Subject to any disclaimer, the term of this patent is extended or adjusted under 35 U.S.C. 154(b) by 0 days.

(21) Appl. No.: 11/736,204

(22) Filed: Apr. 17, 2007

(65) Prior Publication Data

US 2008/0168887 A1 Jul. 17, 2008

Related U.S. Application Data

(60) Provisional application No. 60/880,005, filed on Jan. 12, 2007.

(51) Int. Cl.
*G10D 13/08* (2006.01)

(52) U.S. Cl. ..... 84/411 R

(58) Field of Classification Search ..... 84/411 R, 84/421

See application file for complete search history.

(56) References Cited

U.S. PATENT DOCUMENTS 4,660,455 A 4/1987 Jones et al.
5,419,230 A 5/1995 Ocheltree et al.
5,546,841 A 8/1996 Chen
6,057,499 A 5/2000 Basmadjian
6,121,528 A 9/2000 May
6,211,448 B1 4/2001 Shigenaga et al.
6,380,468 B1 4/2002 Shigenaga
6,927,330 B2 8/2005 May
2004/0261603 A1* 12/2004 May ..... 84/411 R
2005/0120863 A1 6/2005 Dunnett
2005/0188816 A1 9/2005 May

* cited by examiner

*Primary Examiner*—Kimberly R Lockett
(74) *Attorney, Agent, or Firm*—Berenato, White & Stavish, LLC

(57) ABSTRACT

A drum comprising a hollow drum shell having opposite ends and first and second drumheads closing said opposite ends. At least one air vent opening is provided through the drum head for acoustic venting, such that at least one air vent opening is located at a position distanced from at least one of said opposite end by a preset distance range of distances calculated by using the Golden Ratio and an acceptable margin or range of variation therefrom.

12 Claims, 5 Drawing Sheets

Air Vent Position (Hole Center) from Lower Bearing Edge
by Using the Golden Ratio

| Shell Depth | | Air Vent Position | Air Vent Range of Deviation | |
|---|---|---|---|---|
| [in] | Nominal [mm] | Nominal [mm] | +/-10% [mm] | |
| 3 | 76.2 | 29.1 | 27.4 | 31.0 |
| 3.5 | 88.9 | 34.0 | 32.0 | 36.2 |
| 4 | 101.6 | 38.8 | 36.5 | 41.4 |
| 4.5 | 114.3 | 43.7 | 41.1 | 46.5 |
| 5 | 127.0 | 48.5 | 45.7 | 51.7 |
| 5.5 | 139.7 | 53.4 | 50.3 | 56.9 |
| 6 | 152.4 | 58.2 | 54.8 | 62.0 |
| 6.5 | 165.1 | 63.1 | 59.4 | 67.2 |
| 7 | 177.8 | 67.9 | 64.0 | 72.4 |
| 7.5 | 190.5 | 72.8 | 68.5 | 77.6 |
| 8 | 203.2 | 77.6 | 73.1 | 82.7 |
| 9 | 228.6 | 87.3 | 82.2 | 93.1 |
| 10 | 254.0 | 97.0 | 91.4 | 103.4 |
| 11 | 279.4 | 106.7 | 100.5 | 113.8 |
| 12 | 304.8 | 116.4 | 109.6 | 124.1 |
| 13 | 330.2 | 126.1 | 118.8 | 134.4 |
| 14 | 355.6 | 135.8 | 127.9 | 144.8 |
| 15 | 381.0 | 145.5 | 137.1 | 155.1 |
| 16 | 406.4 | 155.2 | 146.2 | 165.5 |
| 17 | 431.8 | 164.9 | 155.3 | 175.8 |
| 18 | 457.2 | 174.6 | 164.5 | 186.1 |
| 19 | 482.6 | 184.3 | 173.6 | 196.5 |
| 20 | 508.0 | 194.0 | 182.7 | 206.8 |

FIG. 5

GOLDEN RATIO AIR VENT HOLES

This application is a nonprovisional patent application based on U.S. Provisional Patent Application No. 60/880,005 filed Jan. 12, 2007 and is hereby incorporated by reference.

BACKGROUND OF THE INVENTION

1. Field of the Invention

The present invention relates to percussion instruments in general and more particularly to an acoustic drum having at least one acoustic air vent hole.

2. Description of Related Art

When a drum is struck, the drumhead is depressed inwardly and forces a column of air down the length of the drum and causes the drumhead on the opposite side to balloon outwardly. If the drum is air tight, the top and bottom heads will oscillate for a relatively long time as the air within the drum oscillates back and forth and feeds energy to the heads to keep the oscillation going. Long oscillation time produces a long sustain which is desirable at slow tempos; however, at faster tempos the oscillation can hamper performance.

For example, oscillation of a drum is analogous to oscillation of a trampoline. If one times his/her jumps to the oscillation of the trampoline, the trampoline will help the jumper maintain a rhythm. However, if one's timing if off, the trampoline will stop. An analogous event happens when one plays a drum. For example, if one plays a drum in phase with the moving drumhead the playing action will feel normal but when one get out of phase with the drumhead, which is very easy to do especially when playing fast and/or when playing intricate patterns, the drumhead can randomly feel dead and stifle rebound and negatively impact your performance.

Air vents allow the air to escape from the drum and return the heads to their resting state quickly thus providing an essentially flat and predictable playing surface on which to play for improved confidence, speed, and intricacy.

Companies typically choose the air vent locations for drums based on cosmetics considerations instead of science or sound. Some attempts have been made to attenuate the movement of air through vent holes by adjusting the size of the vent hole or by using an adjustable valve on the vent hole. However, no prior art is known to exist that enhances drum performance based on air vent location.

SUMMARY OF THE INVENTION

A drum is provided that comprises a hollow drum shell having opposite ends and first and second drumheads closing said opposite ends. At least one air vent opening is provided through the drum shell for acoustic venting. In accordance with this invention, the air vent opening(s) is/are located at a position distanced from at least one of said opposite end by a preset distance range of distances calculated by using the Golden Ratio and an acceptable margin or range of variation therefrom.

In accordance with one application of the invention, at least two acoustic vent holes are formed in the drum shell. The location of both the vent holes is determined by the "Golden Ratio". The location of the first "bottom" vent hole is defined by the lower "Golden Ratio", while the location of the second "attack" vent hole is defined by the upper "Golden Ratio". A plug can be provided to selectively plug the upper or lower acoustic vent holes depending on the desired sound. Thus, a user can have more "attack" by plugging the bottom air vent or more "depth" by plugging the upper air vent.

BRIEF DESCRIPTION OF THE DRAWINGS

Other objects and advantages of the invention will become apparent from a study of the following specification when viewed in light of the accompanying drawings, wherein:

FIG. 5 shows exemplary air vent positions (hole centers) from a lower bearing edge of an acoustic drum by using the Golden Ratio.

DESCRIPTION OF PREFERRED EMBODIMENTS

Figure 1:
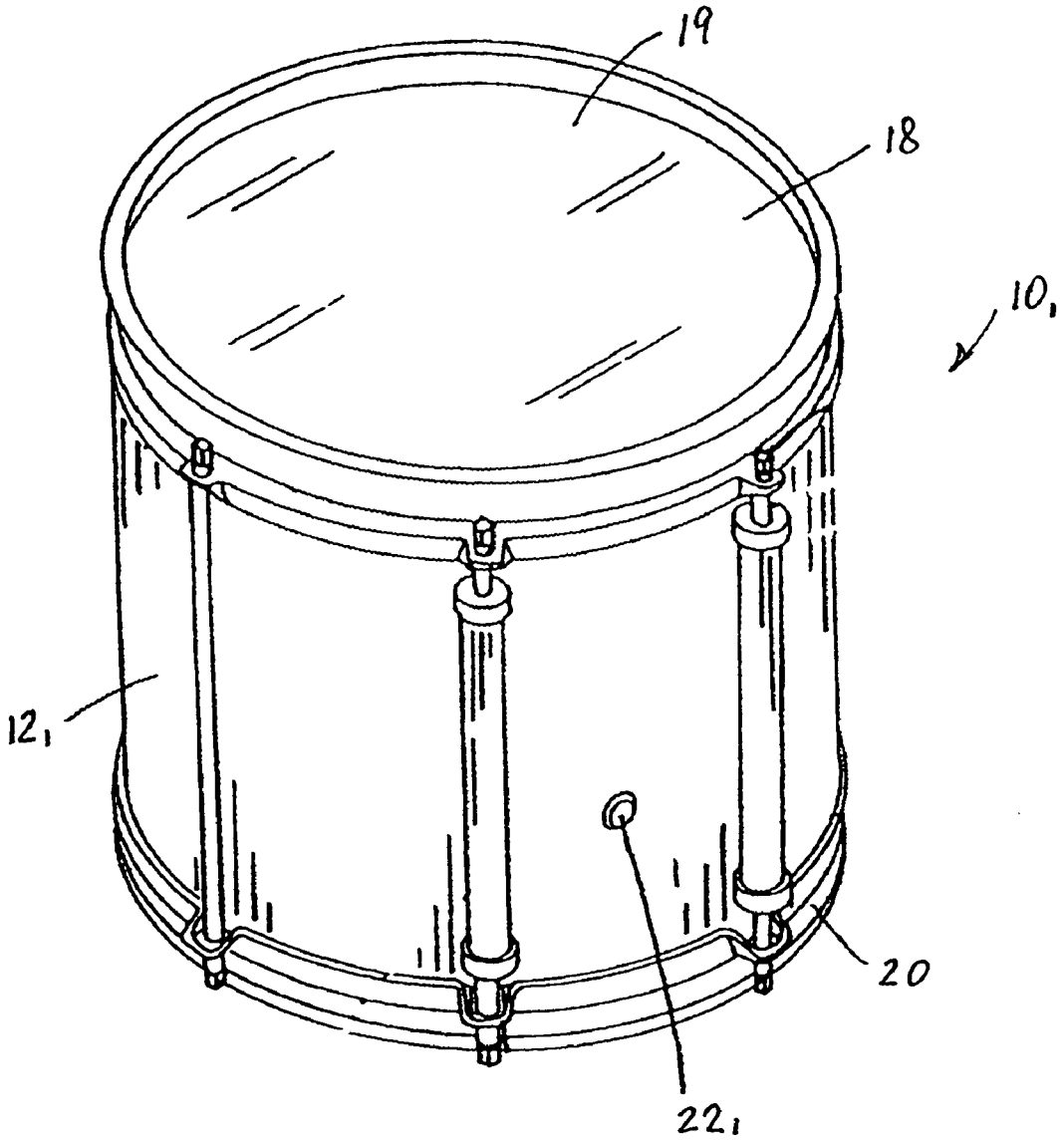
FIG. 1 is a perspective view of an acoustic drum in accordance with a first exemplary embodiment of the present invention.
Figure 2:
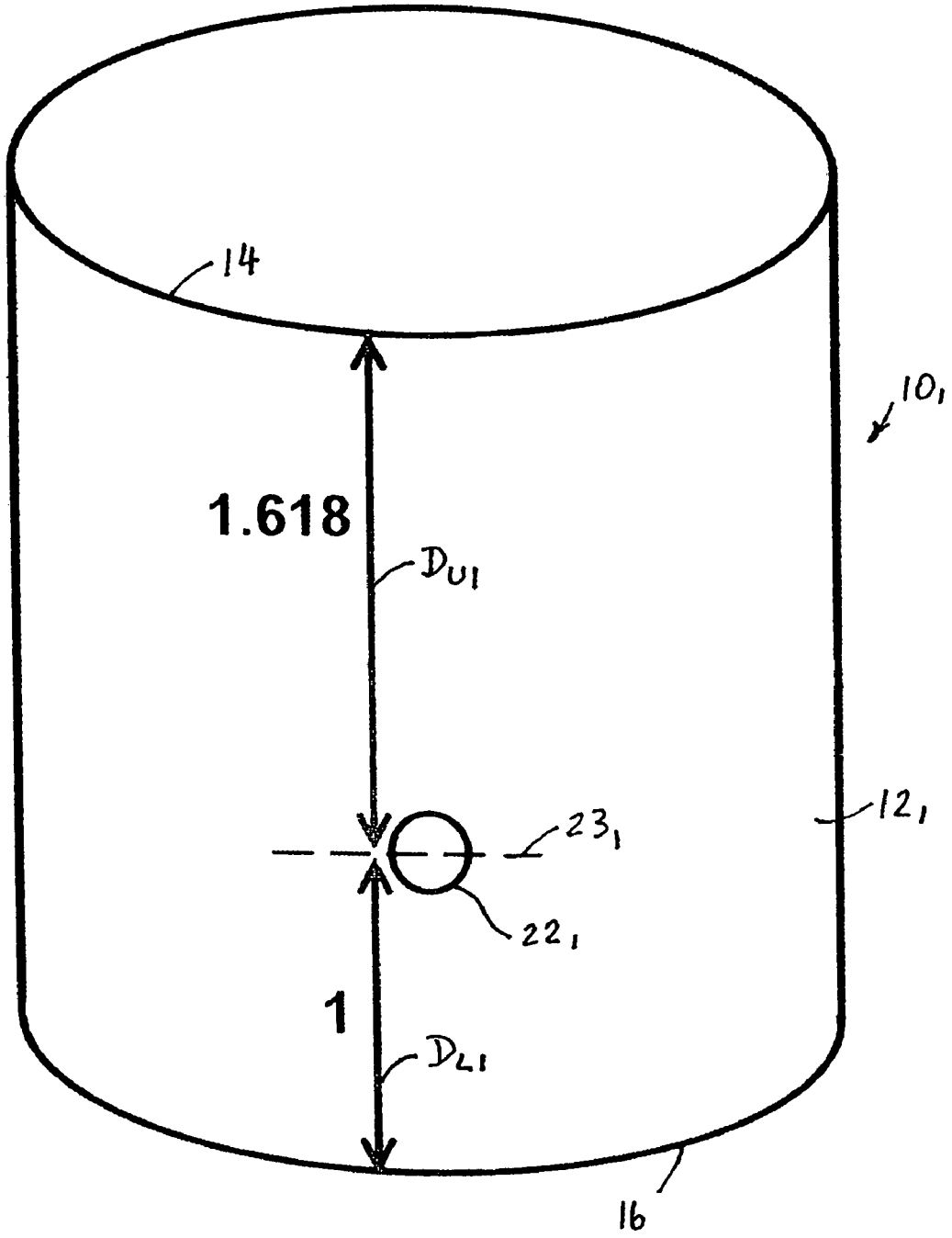
FIG. 2 is a schematic view of an acoustic drum shell in accordance with the first exemplary embodiment of the present invention.

FIGS. 1 and 2 of the drawings illustrate in detail a first exemplary embodiment of an acoustic drum $\mathbf{10}_1$ in accordance with the present invention. As illustrated in FIG. 1, the acoustic drum $\mathbf{10}_1$ comprises a substantially cylindrical drum shell $\mathbf{12}_1$ having an upper (top) bearing edge 14 and a lower (bottom) bearing edge 16. The acoustic drum $\mathbf{10}_1$ further comprises upper (top) and lower (bottom) drumheads 18 and 20, respectively, mounted to opposite ends of the drum shell $\mathbf{12}_1$. According to the first exemplary embodiment of the present invention, the drum shell $\mathbf{12}_1$ is provided with an acoustic vent in the form of an acoustic vent hole $\mathbf{22}_1$.

When the acoustic drum $\mathbf{10}_1$ is struck, a membrane of the drumhead, such as the membrane 19 of the upper drumhead 18, is depressed inwardly and forces a column of air down the length of the acoustic drum $\mathbf{10}_1$ and causes the drumhead on the opposite side, such as the lower drumhead 20, to balloon outwardly. If the drum is air tight, the top and bottom heads will oscillate for a relatively long time as the air within the drum oscillates back and forth and feeds energy to the heads to keep the oscillation going. Long oscillation time produces a long sustain which is desirable at slow tempos; however, at faster tempos the oscillation can hamper performance.

The acoustic vent hole $\mathbf{22}_1$ allows the air to escape from the drum $\mathbf{10}_1$ and return the drumheads 18 and 20 to their resting state quickly, thus providing an essentially flat and predictable playing surface on which to play for improved confidence, speed, and intricacy.

Most companies put the air vent in locations on the drum based on cosmetics consideration rather than scientific or acoustic considerations.

According to the present invention, location of the acoustic vent hole in the direction of the length (or depth) of the acoustic drum is defined by the "Golden Ratio" because the location defined by the Golden Ratio has been proven by the instant inventors to be the optimal location for the vent hole(s) to maximize the functional and tonal qualities of the drum. As will be described below, the best sound qualities are achieved for both an "attack" sound or a "bottom" sound when the location of the vent hole(s) are dictated by the "Golden Ratio."

The "Golden Ratio", usually denoted $\phi$, expresses the relationship that the sum of two quantities is to the larger quantity as the larger is to the smaller. The golden ratio is the following algebraic irrational number with its numerical approximation:

$$\varphi = \frac{1+\sqrt{5}}{2} \approx 1.618033989.$$

Algebraically the "Golden Ratio" is expressed as following:

$$\frac{a+b}{a} = \frac{a}{b} = \varphi.$$

According to the first exemplary embodiment of the present invention, the acoustic vent hole $\mathbf{22}_1$ is positioned in the lower "Golden Ratio" location (closer to the bottom drumhead 20 of the drum $\mathbf{10}_1$). As illustrated in detail FIG. 2, a centerline $\mathbf{23}_1$ of the vent hole $\mathbf{22}_1$ is spaced from the top edge 14 of the drum shell $\mathbf{12}_1$ to a length $D_{U1}$, and from the bottom edge 16 thereof to a length $D_{L1}$. According to the first exemplary embodiment of the present invention, a ratio of the length $D_{U1}$ to the length $D_{L1}$ substantially equals to the "Golden Ratio", i.e. 1.618033989. With the air vent hole in the lower "Golden Ratio" location (closer to the bottom head of the drum), more sustain and a fuller, deeper sound can be heard. This is advantageous for the player who wants a more melodious sound. It is noted that the location of the vent hole $\mathbf{22}_1$ may be located within a range of tolerance or deviation of about 10% from the exact location determined by the "Golden Ratio."

Further, according to the first exemplary embodiment of the present invention, the acoustic drum $\mathbf{10}_1$ could be turned upside down to achieve more "attack", or "aggressive", sound.

Figure 3:
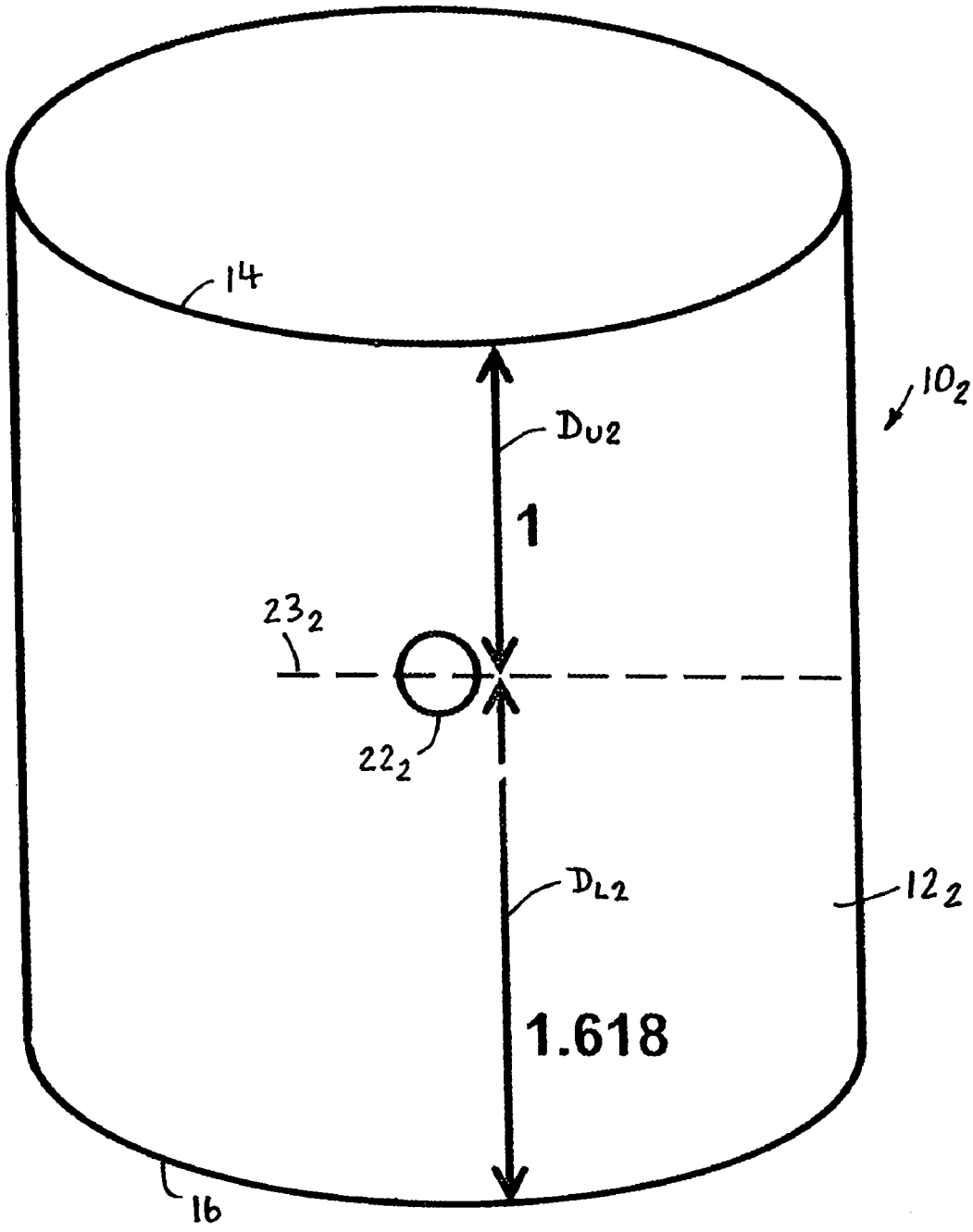
FIG. 3 is a schematic view of an acoustic drum shell in accordance with a second exemplary embodiment of the present invention.

FIG. 3 of the drawings illustrates a second exemplary embodiment of an acoustic drum $\mathbf{10}_2$ in accordance with the present invention. The acoustic drum $\mathbf{10}_2$ of the second exemplary embodiment is substantially similar to the acoustic drum $\mathbf{10}_1$ of the first exemplary embodiment and differs by location of an acoustic vent hole $\mathbf{22}_2$ formed in a drum shell $\mathbf{12}_2$. In FIG. 3, a length $D_{U2}$ defines a distance between a centerline $\mathbf{23}_2$ of the vent hole $\mathbf{22}_2$ to the top edge 14 of the drum shell $\mathbf{12}_2$, while a length $D_{L2}$ defines a distance between the centerline $\mathbf{23}_2$ of the vent hole $\mathbf{22}_2$ to the bottom edge 16 of the drum shell $\mathbf{12}_2$. According to the second exemplary embodiment of an acoustic drum $\mathbf{10}_2$, a ratio of the length $D_{L2}$ to the length $D_{U2}$ substantially equals to the "Golden Ratio", i.e. 1.618033989. With the air vent in the upper "Golden Ratio" location (closer to the top head that is struck), more "attack", the sound of the sticks striking the head, can be heard. This is advantageous for the player who wants a more "aggressive" and percussive sound. As previously noted, the location of the vent hole $\mathbf{22}_1$ may be located within a range of tolerance or deviation of about 10% from the exact location determined by the "Golden Ratio" without substantially deteriorating the sound quality of the drum.

Further according to the second exemplary embodiment of the present invention, the acoustic drum $\mathbf{10}_2$ could be turned upside down to achieve more "deep", melodious sound.

Figure 4:
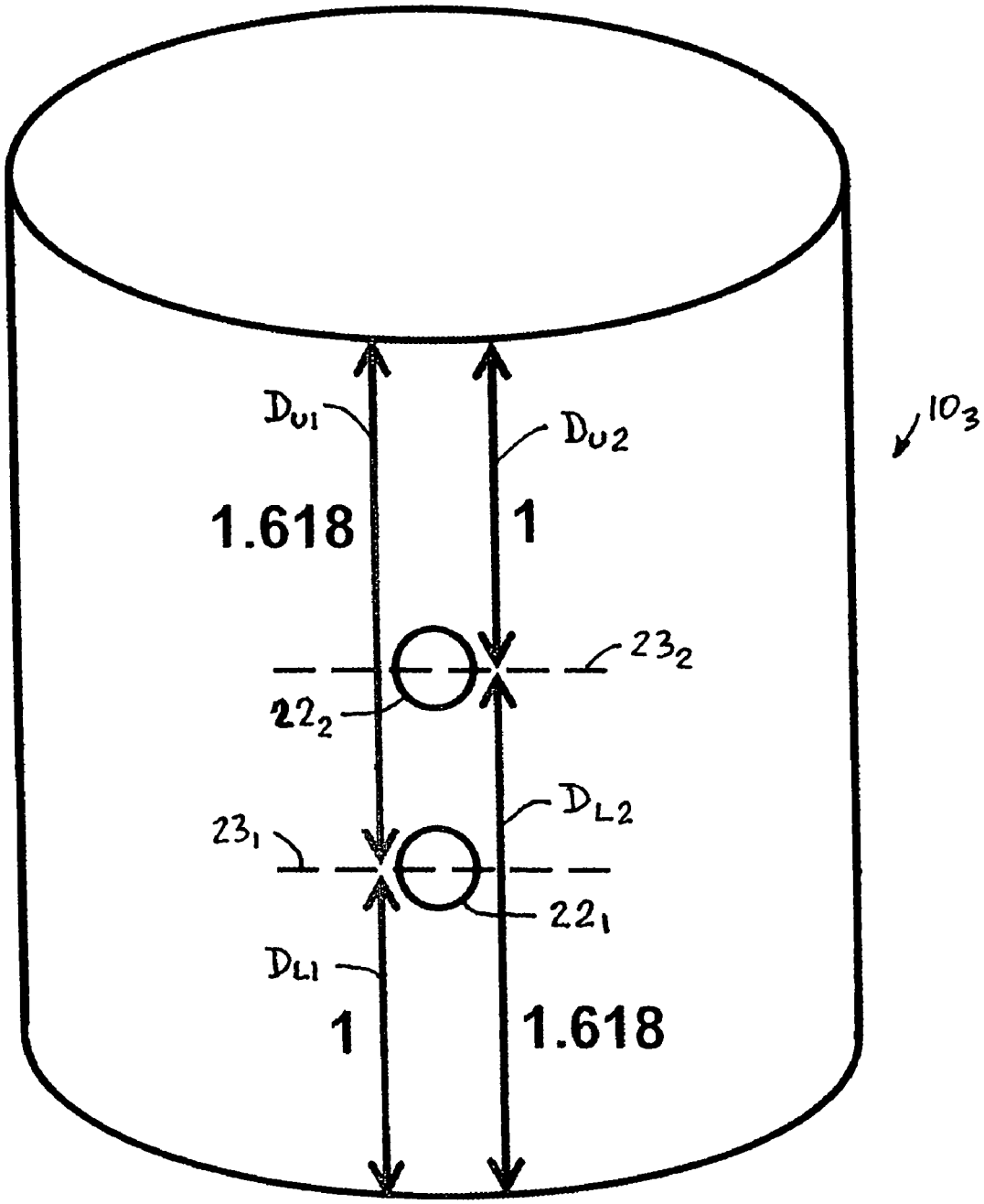
FIG. 4 is a schematic view of an acoustic drum shell in accordance with a third exemplary embodiment of the present invention.

FIG. 4 of the drawings illustrates a third exemplary embodiment of an acoustic drum $\mathbf{10}_3$ in accordance with the present invention. The acoustic drum $\mathbf{10}_3$ comprises a substantially cylindrical drum shell having two acoustic vent holes $\mathbf{22}_1$ and $\mathbf{22}_2$ formed in the drum shell. As illustrated in FIG. 4, the location of both the both acoustic vent holes $\mathbf{22}_1$ and $\mathbf{22}_2$ is determined by the "Golden Ratio". Specifically, the location of the acoustic vent hole $\mathbf{22}_1$ is defined by the lower "Golden Ratio", while the location of the acoustic vent hole $\mathbf{22}_2$ is defined by the upper "Golden Ratio". According to the third exemplary embodiment, a plug can be provided to selectively plug the upper or lower acoustic vent holes $\mathbf{22}_1$ and $\mathbf{22}_2$ depending on the desired sound. Thus, one drum can have more "attack" by plugging the bottom air vent $\mathbf{22}_1$ or more "depth" (i.e., bottom) by plugging the upper air vent $\mathbf{22}_2$.

Therefore, in practical application of the present invention, it is possible to apply acoustic vent holes three ways:

a) One air vent at the lower Golden Ratio location +/−a 10% deviation;

b) One air vent at the upper Golden Ratio location +/−a 10% deviation;

c) One air vent at the upper Golden Ratio location and another at the lower Golden Ratio location (with appropriate deviations), whereby the user selectively plug one air vent during use.

Exemplary air vent positions (hole centers) from a lower bearing edge of an acoustic drum by using the Golden Ratio is shown in FIG. 5.

On all drums it's possible to apply more than one air vent hole. As one would expect, more air vent holes increase the amount of air that can be purged. This is especially beneficial for larger drums, such as bass drums, that move a larger volume of air compared smaller drums.

While the description thus far has focused on the specific and preferred embodiment where the Golden Ratio location exactly defines the location for the vent hole(s), it will be understood by those of skill in the art that the specific location may be varied from the exact location defined by the Golden Ratio without substantially detracting from the preferred performance defined by the Golden Ratio. Substantially the same performance may be obtained if the vent holes are located within about a 10% deviation from the exact location defined by the Golden Ratio. Therefore, the table shown in FIG. 5 provides a series of examples for the exact location for the air vent with an acceptable margin or range of variation of about +/−10%. Based on tests conducted by the inventors, the calculation for the acceptable margin of variation uses a Golden Ratio range of 1.4562 to 1.7798. Thus, for the first example listed in FIG. 5, a product having a nominal shell depth of 76.2 mm would have an air vent located in a range of 27.4 mm to 31.0 mm from the lower bearing edge, and a product having a shell depth of 508 mm would have an air vent location of 182.7 mm to 206.8 mm from the lower bearing edge. FIG. 5 shows these and other deviation ranges ("Air Vent Range of Deviation") from the exact Golden Ratio location of the air vent for the shell sizes listed in FIG. 5.

Other changes may be made to the foregoing invention without departing from the spirit and scope of the present invention as understood by those of skill in the art.

The invention claimed is:

1. A drum comprising:

a hollow drum shell having first and second opposite ends;

at least one opening through said drum shell for acoustic venting, wherein said at least one opening is located at a position distanced from at least one of said opposite end by a preset distance within a predetermined deviation, wherein said present distance is calculated by dividing a total depth of the drum shell by 2.618.

2. The drum according to claim 1, further comprising first and second drumheads closing said first and second opposite ends.

3. The drum according to claim 1, wherein a first distance from said first opposite end to said at least one opening divided by a second distance from said second opposite end to said at least one opening is within a range from 1.4562 to 1.7798.

4. The drum according to claim 1, where said preset distance is calculated by dividing a depth of the drum shell by 2.4562 to 2.7798 when taking into account said predetermined deviation.

5. The drum according to claim 1, wherein at least first and second air vents are disposed at equal distances from each of said opposite ends respectively, said equal distances being calculated by dividing a depth of the drum shell by 2.4562 to 2.7798.

6. The drum according to claim 5, further comprising a plug device for selectively closing one of said first and second air vents.

7. A method of locating an air vent in a drum shell, said method comprising the steps of:

providing a hollow drum shell having opposite ends;

providing at least one opening through said drum shell for acoustic venting, locating said at least one opening at a position distanced from at least one of said opposite end by a preset distance within a predetermined deviation, wherein said step of locating comprises a step of calculating said preset distance by dividing a depth of the drum shell by 2.618.

8. The method according to claim 7, further comprising the step of providing first and second drumheads closing said opposite ends.

9. The method according to claim 7, wherein said step of locating comprises the step of dividing a first distance from said first opposite end to said at least one opening by a second distance from said second opposite end to said at least one opening, such that said step of dividing result in a number within a range from 1.4562 to 1.7798.

10. The method according to claim 7, where said step of locating comprises the step of calculating said preset distance by dividing a depth of the drum shell by 2.4562 to 2.7798.

11. The method according to claim 7, wherein at least first and second air vents are disposed at distances from each of said opposite ends, said equal distances being calculated by dividing a depth of the drum shell by 2.4562 to 2.7798.

12. The method according to claim 11, further comprising a step of disposing a plug device in one of said first and second air vents for selectively closing one of said first and second air vents.

* * * * *